United States Patent [19]

Pipp

[11] Patent Number: 4,472,912

[45] Date of Patent: Sep. 25, 1984

[54] SHOE STORE CONCEPT

[76] Inventor: Thomas J. Pipp, 2561 Pebblebrook, SE., Grand Rapids, Mich. 49506

[21] Appl. No.: 329,308

[22] Filed: Dec. 10, 1981

[51] Int. Cl.[3] ..... E04H 3/04

[52] U.S. Cl. ..... 52/28; 52/29; 52/36; 186/52

[58] Field of Search ..... 52/27, 28, 29, 33, 36, 52/234, 211, 312; 186/52

[56] References Cited

U.S. PATENT DOCUMENTS

| | | | |
|---|---|---|---|
| 309,951 | 12/1894 | Hoffman | 52/36 |
| 2,285,962 | 6/1942 | Foulkes | 52/33 |
| 2,971,805 | 2/1961 | Weiss | 52/36 |
| 3,471,978 | 10/1969 | Fenwick | 52/28 |
| 4,288,948 | 9/1981 | Harris | 52/28 |

FOREIGN PATENT DOCUMENTS

| | | | |
|---|---|---|---|
| 367456 | 2/1932 | France | 52/33 |

*Primary Examiner*—Alfred C. Perham

*Attorney, Agent, or Firm*—Price, Heneveld, Huizenga & Cooper

[57] ABSTRACT

A retail footwear assembly including a storage zone containing a stock of shoes and a customer service zone. The customer service zone includes a service counter over which shoes can be passed, a walkway for sales personnel adjacent a first side of the service counter and communicating with the storage zone and a customer fitting area including seating adjacent a second side of the service counter opposite the walkway. In a first preferred embodiment, the storage zone is separated from the customer service zone by a partition, which defines a passage communicating with the walkway. In a second preferred embodiment, the storage zone includes high density shelving adjacent the walkway opposite the service counter.

3 Claims, 16 Drawing Figures

SHOE STORE CONCEPT

BACKGROUND OF THE INVENTION

The present invention relates to retail stores, and more particularly self-service retail stores.

The conventional retail shoe store is typically divided into a storage zone and a customer service zone. When a customer desires to try shoes in such a store, he enters the service zone and requests particular sizes and styles of shoes from a salesman who retrieves the requested shoes from the storage zone and fits the shoes on the customer. Usually, the service zone includes customer seating, upon which customers sit, and a plurality of shoe benches upon which the salesmen sit when fitting shoes on the customers. In such a store, one salesman can usually service only a single customer at a given time, because of the time required of the salesman to retrieve shoes from the storage zone and to fit the shoes on the customer's feet. Consequently, multiple salespeople are required to serve multiple customers simultaneously. Further, if more customers than salespeople desire service, some customers must wait while the customers ahead of them are served sequentially by the available salespeople. Many of these customers become impatient and leave before being serviced, resulting in a lost potential sale.

Conventional retail shoe stores have at least two additional drawbacks. First, merchandise is difficult to control due to the fact that as customers are served at various locations throughout the service zone, the shoes which they have requested accumulate in the service zone so that merchandise is spread out over the entire service zone. Second, many customers who are in the service zone merely browsing are discouraged from browsing when approached by an, at that time, undesired salesperson.

SUMMARY OF THE INVENTION

The aforementioned problems are solved by the present invention. Essentially, a store for the retail sale of footwear is provided wherein a single salesperson can service multiple customers at a common service counter by retrieving for each customer requested items of footwear from a storage zone and handing the footwear over to the customers to try themselves. More particularly, the store includes a storage zone for storing a stock of footwear and a customer service zone adjacent the storage zone. The service zone in turn includes the service counter over which footwear can be passed, a walkway for sales personnel adjacent a first side of the service counter and communicating with the storage zone, and a customer fitting area adjacent a second side of the counter opposite the walkway wherein customers may try footwear.

In the store of the present invention, a customer can enter the fitting area and request a particular size and style of footwear from a salesman on the walkway opposite the counter from the customer. The salesman then retrieves the requested footwear from the storage zone and hands the footwear over the service counter to the customer for trying. The salesperson can service other customers while the first customer is trying his footwear. If unsatisfied with either the size or style of a requested item, the customer can request another item of a different size and/or style. Again, the salesperson retrieves the requested item from the storage zone and hands the item over the service counter to the customer.

This interactive process between the customer and salesperson continues so that the customer can make a purchasing descision.

The store of the present invention has significant advantages over conventional retail stores. First, the number of customers serviceable by a salesperson is increased due to the fact that the salesperson can retrieve footwear for other customers while a first customer is trying his requested footwear. Consequently, fewer salespeople are required than in conventional stores. Second, because many customers can be serviced at a given time, customer waiting time is reduced so that potential sales are not lost. Third, control of merchandise is improved due to the fact that the merchandise stays in close proximity to the service counter under the watchful eye of the salespeople. Further, customers browsing in portions of the fitting area not adjacent the service counter are not approached by unsolicited salespeople.

These and other objects, advantages, and features of the invention will be more fully understood and appreciated by reference to the written specification and appended drawings.

DESCRIPTION OF THE PREFERRED EMBODIMENT

Figure 1:
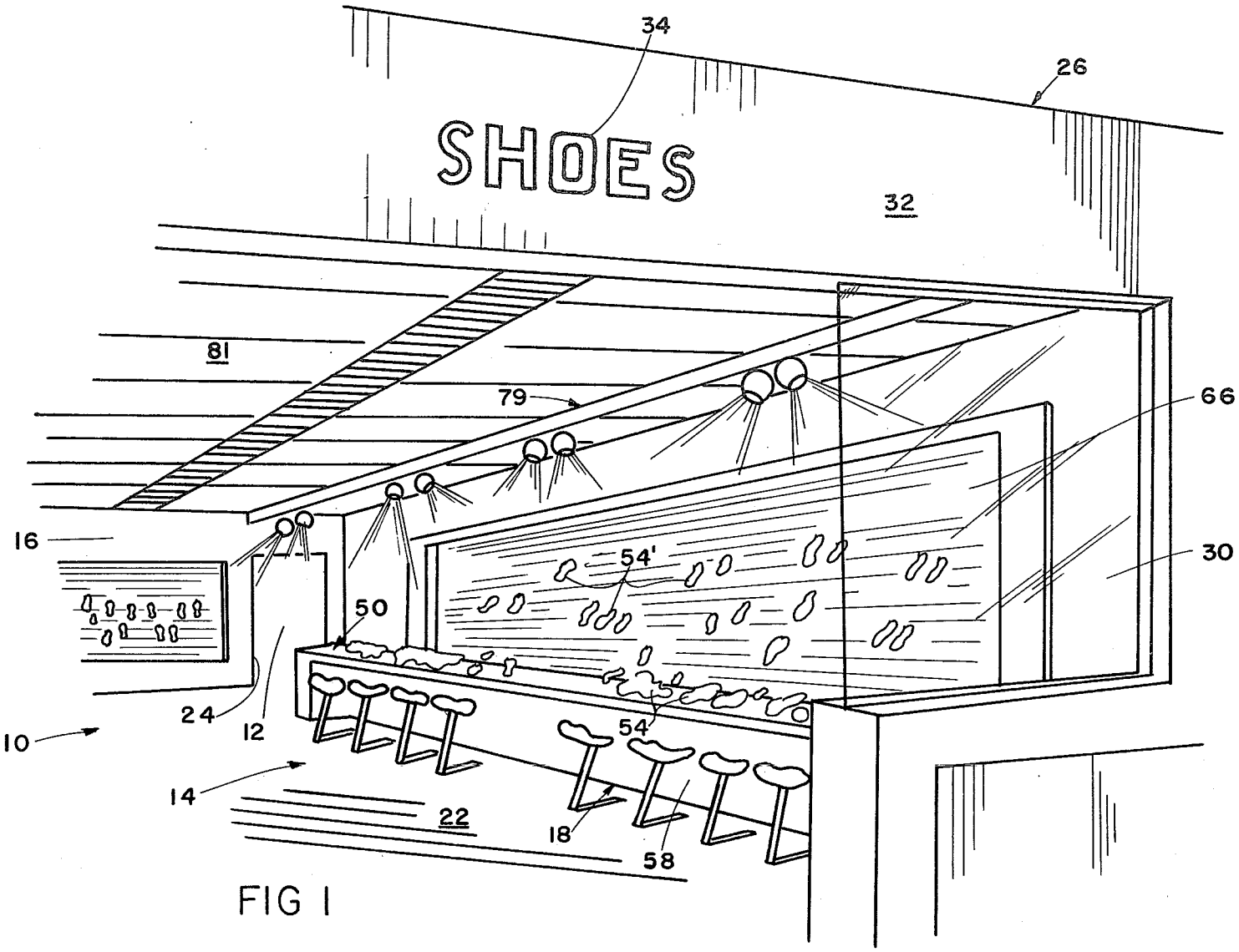
FIG. 1 is a fragmentary, perspective view of the store of the present invention.
Figure 2:
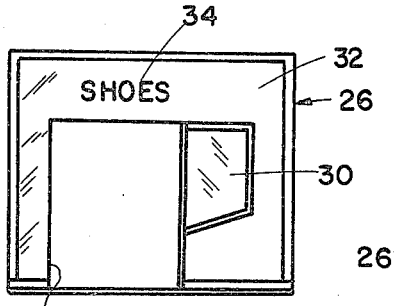
FIG. 2 is an elevational view of the store front.
Figure 3:
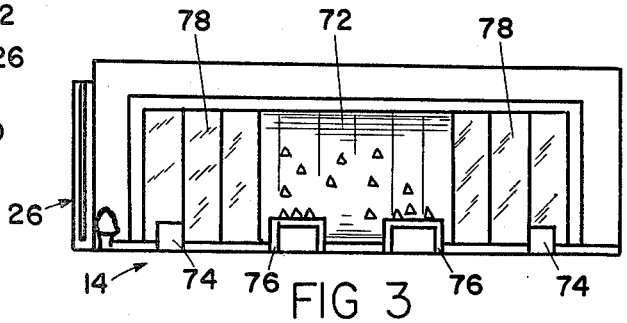
FIG. 3 is an elevational view of the fitting area wall opposite the service counter.
Figure 4:
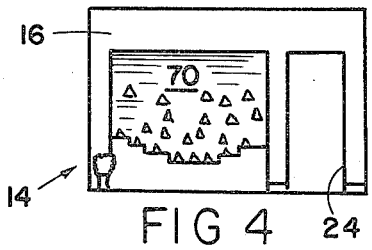
FIG. 4 is an elevational view of the rear wall of the customer service zone.
Figure 5:
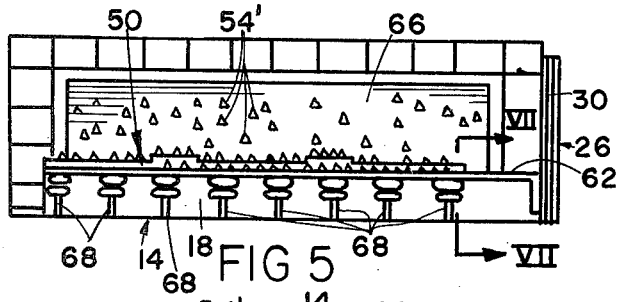
FIG. 5 is an elevational view of the service counter and store wall therebehind.

Retail store 10 (FIGS. 1-6) in accordance with a preferred embodiment of the invention is divided into storage zone 12 and customer service zone 14 by partition 16. Service zone 12 includes service counter 18, walkway 20 for sales personnel adjacent a first side of the service counter, and a customer fitting area 22 adjacent the service counter opposite the walkway. A passage 24 extends through partition 16 so that walkway 20 communicates with storage zone 12 through the passage. Multiple customers are easily and rapidly serviced in store 10 by a single salesperson. As customers enter fitting area 22, they may browse at shoes 54 located throughout the area. When ready to try a pair of shoes, the customer approaches service counter 18 and requests particular size and style shoes from the salesperson on walkway 20. The salesperson then enters storage zone 12 through passage 24 to retrieve the requested shoes and hand same over service counter 18 to the customer. After trying the requested shoes, the customer can request shoes of other sizes and/or styles to aid him in making a purchasing decision. Because the customers try the requested shoes themselves, a single salesperson can service all of the customers seated at the service counter by retrieving shoes for certain customers while other customers are trying their requested shoes.

Figure 6:
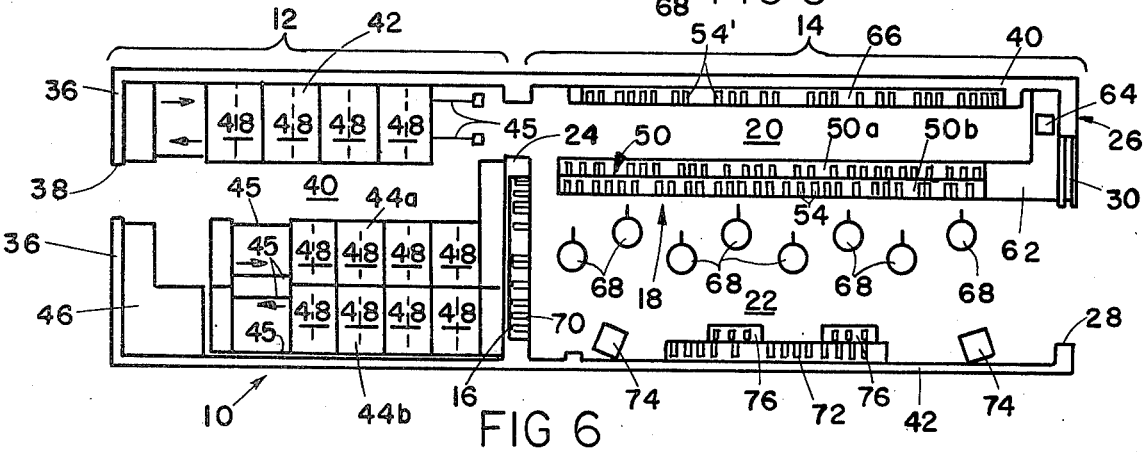
FIG. 6 is a plan view of the store.

Store 10 has an elongated floor plan, being approximately three and a half times as long as it is wide (FIG. 6). Accordingly, store 10 is particularly efficient and desirable where store frontage is at a premium, for example in malls or downtown shopping districts. The store includes a facade 26 (FIGS. 2, 3, 5, and 6) defining a customer entrance 28 communicating with fitting area 22 (FIG. 6). Display window 30 (FIGS. 1, 2, 5, and 6) is mounted in facade 26 adjacent entrance 28 to provide display or viewing area to people outside of the store. Facade 26 includes a marquis 32 (FIGS. 1 and 2) supporting lettering 34, which identifies the store, or provides other information. Along with facade 26, the perimeter of store 10 is defined by rear wall 36 and side walls 41 and 43 extending between facade 26 and rear wall 36.

Partition 16 (FIGS. 1, 4, and 6) extends between side walls 41 and 43 to divide the floor space of store 10 into approximately 40% storage zone 12 and 60% customer service zone 14 (see FIG. 6). Of course, partition 16 could be positioned to make storage zone 12 relatively larger or smaller with respect to customer service zone 14. Partition 16 defines passage 24 between storage zone 12 and service zone 14. Preferably, passage 24 is door-shaped and open so that sales personnel can walk freely between walkway 20 and storage zone 12, particularly when carrying merchandise.

Storage zone 12 (FIG. 6) includes an aisle 40 extending from service door 38 in rear wall 36 to passage 24 in partition 16. Bank 42 of high density, rolling shelving is positioned on one side of aisle 40, and two adjacent banks **44*a* and 44*b* of high density, rolling shelving is positioned on a second side of the aisle opposite bank 42. Rolling shelving 42, 44*a*, and 44*b* is well known to those having ordinary skill in the art, and consequently, a detailed description of its construction and operation is unnecessary. Suffice it to say, that each bank 42 includes a plurality of movable units 48 arranged in side-by-side relation on tracks 45 to be movable toward and away from one another. Each of units 48 contains a plurality of horizontally disposed shelves along its height so that shoe boxes can be stored within each unit. Service desk 46 is included in storage zone 12 between wall 36 and shelving 44*a* and 44*b***.

Figure 7:
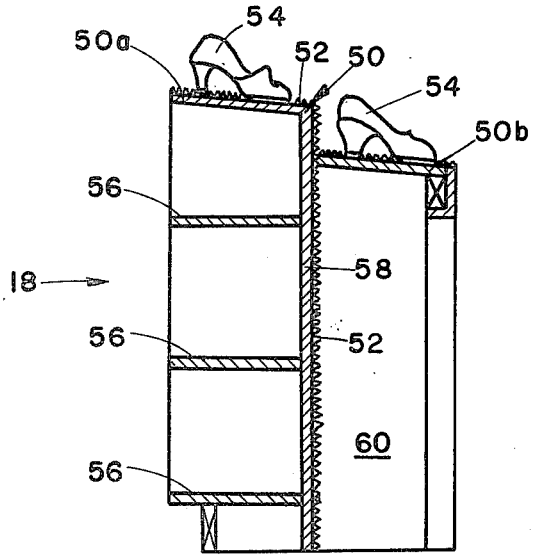
FIG. 7 is a sectional view taken along plane VII—VII in FIG. 5.
Figure 8:
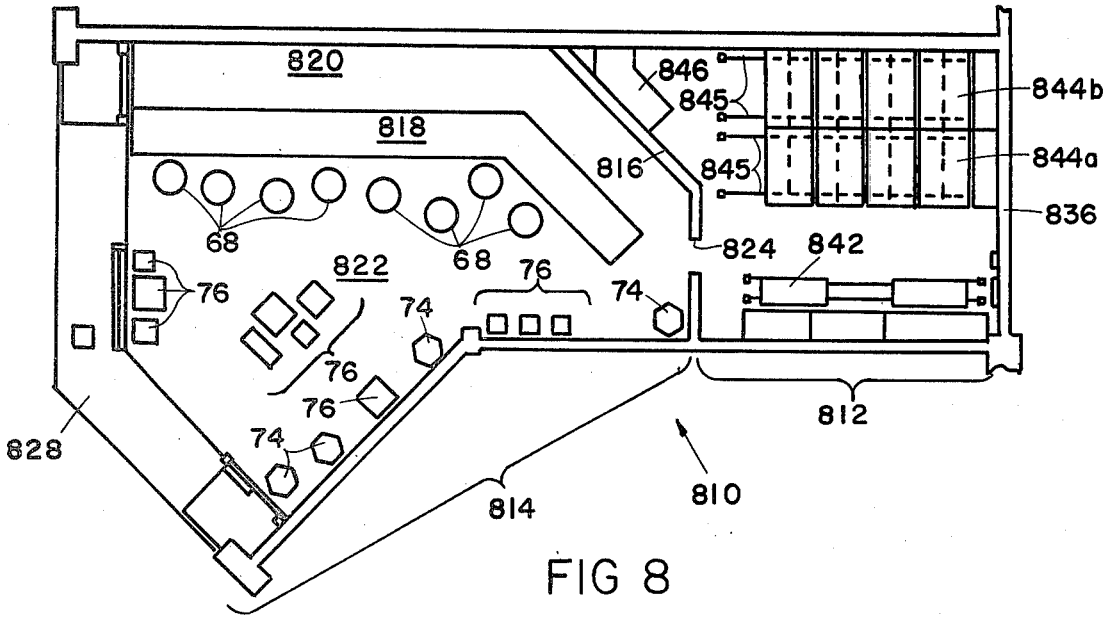
FIG. 8 is a plan view of a first alternative embodiment of the store.
Figure 11:
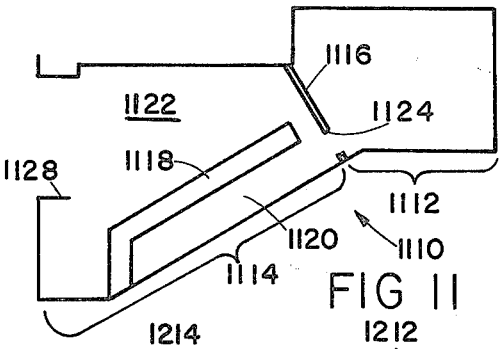
FIG. 11 is a plan view of a fourth alternative embodiment of the store.
Figure 12:
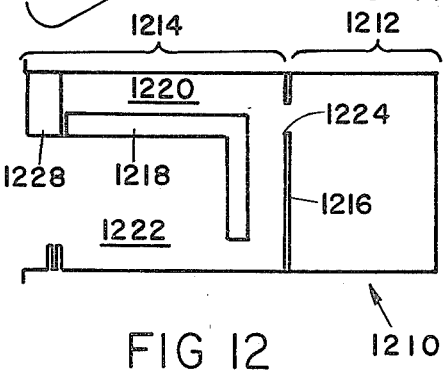
FIG. 12 is a plan view of a fifth alternative embodiment of the store.
Figure 9:
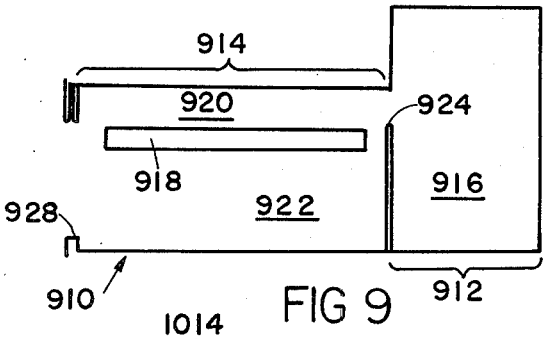
FIG. 9 is a plan view of a second alternative embodiment of the store.
Figure 10:
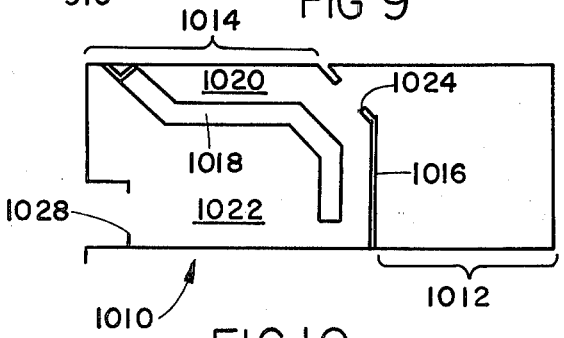
FIG. 10 is a plan view of a third alternative embodiment of the store.
Figure 13:
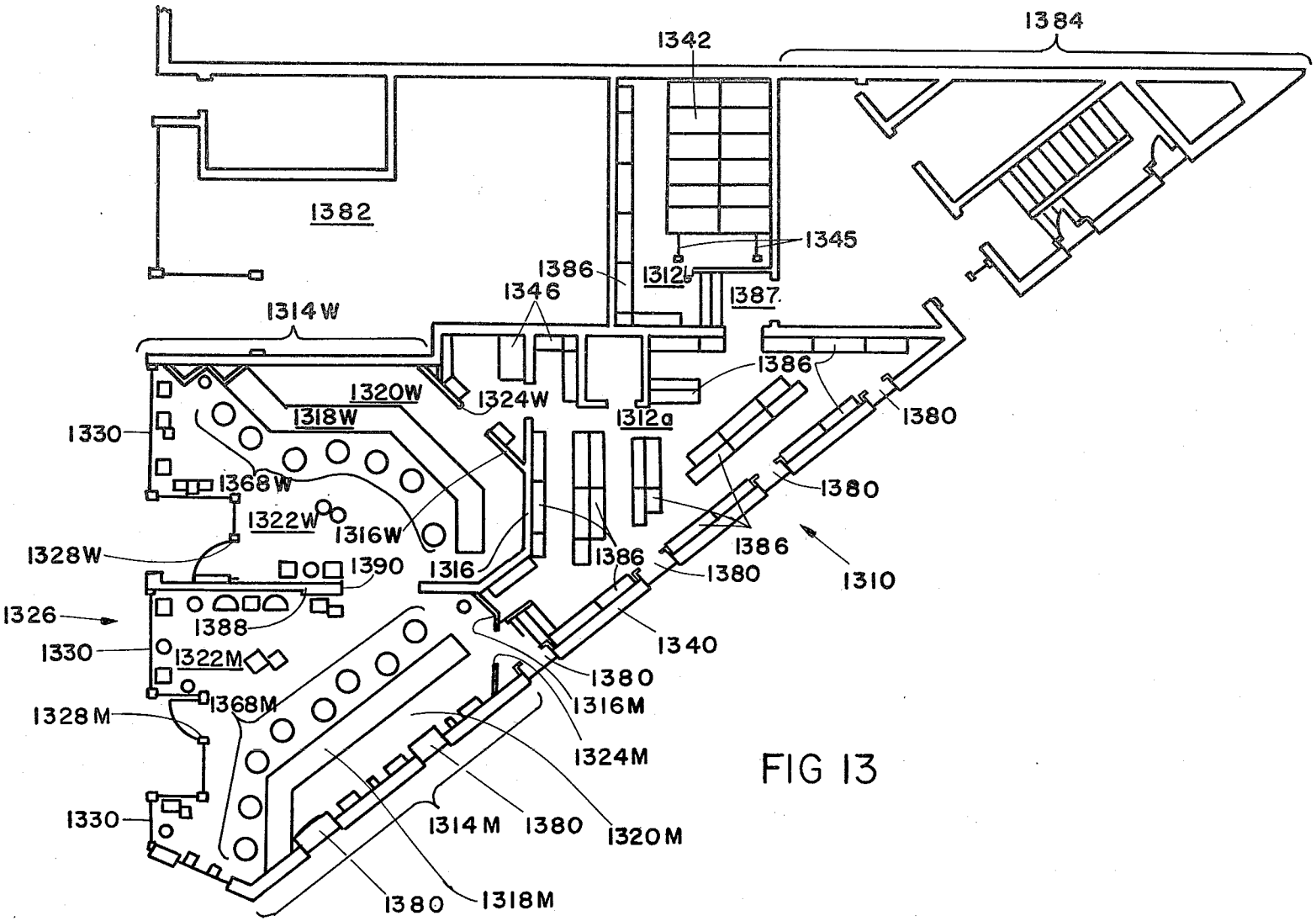
FIG. 13 is a plan view of a sixth alternative embodiment of the store including both men's and women's service zones.

Customer service zone 14 (FIGS. 1, 3, 4, 5, and 6) includes customer service counter 18 (FIGS. 1, 5, 6, and 7), walkway 20 (FIG. 6) adjacent a first side of the counter, and customer fitting area 22 (FIGS. 1 and 6) adjacent a second side of the counter opposite the walkway. Counter 18 includes a two-tier countertop 50 partially supported on kickboard 58 and including upper tier **50*a* positioned behind lower tier 50*b* (FIG. 7). Lower tier 50*b* extends forwardly from kickboard 58 into fitting area 22 to define leg space 60 underneath the tier. Service counter 18 includes rearwardly opening shelves 56 along its height, all of which are also partially supported by kickboard 58. Additional stock may be stored in shelves 56 for rapid access. Both countertop 50 and kickboard 58 are covered with a non-skid surface 52, such as carpet. Service counter 18 further includes cash/wrap area 62 extending between two-tier countertop 50 and store facade 26. Cash register 64 is positioned on cash/wrap area 62** for recording sales and storing money.

Walkway 20 (FIG. 6) is adjacent the entire length of service counter 18 and is generally aligned with passage 24 leading into storage zone 12. Vertically arranged store display 66 (FIGS. 1, 5, and 6) is positioned on side wall 41 adjacent walkway 20 opposite service counter 18. In the preferred embodiment, display 66 is a slatted surface into which brackets may be inserted to support display shoes 54'. Alternatively, display 66 could comprise, for example, a graphic design.

Customer fitting area 22 (FIGS. 1 and 6) includes a plurality of customer seats 68 (FIGS. 1, 5, and 6) so that customers may be seated at service counter 18. Fitting area 22 also includes vertical display 70 on partition 16 (FIGS. 4 and 6) and vertical display 72 on side wall 43 (FIGS. 3 and 6), both of which are similar to display 66, to provide additional display area. Stools 74 (FIG. 6) are positioned in fitting area 22 upon which browsers may rest while in the store. Display tables 76 are positioned substantially adjacent vertical display 72, again to provide additional merchandise display. Flanking either side of vertical display 72 are mirrors 78 (FIG. 3) which enable customers trying shoes to view themselves to further aid them in making purchasing decisions.

Track lighting 79 is mounted on ceiling 81 (FIG. 1) and arranged to direct light onto countertop 50 and vertical displays 66. Of course, additional lighting can be included to direct light onto displays 70 and 72 and display tables 76.

ALTERNATIVE EMBODIMENTS

Alternative floor plans for store 10 are shown in FIGS. 8, 9, 10, 11, 12, and 13. Although the size and shape of the floor plans of alternative stores 810, 910, 1010, 1110, and 1210 are somewhat different from store 10, the basic concept is the same. The alternative embodiments evidence the adaptability of the present invention to a store space having virtually any size and dimension.

Alternative store 810 (FIG. 8) includes a storage zone 812 and customer service zone 814 separated by angled partition 816 defining passage 824. Service zone 814 includes an angular counter 818, a walkway for sales personnel 820 adjacent a first side of the counter and communicating through passage 824 with storage zone 812, and a customer fitting area 822 adjacent the service counter opposite the walkway. Arranged within the fitting area are customer seats 868, stools 874, and display tables 876. Storage zone 812 includes banks 842, **844*a* and 844*b* of rolling shelving as well as service desk 846**.

Store 910 (FIG. 9) is designed to fit a generally L-shaped space and includes storage zone 912, customer service zone 914, and partition 916 defining passage 924 between the two zones. The service zone includes a linear service counter 918, walkway 920 therebehind and communicating with storage zone 912 through passage 924, and fitting area 922. Store entrance 928 provides access to the customer service zone.

Store 1010 (FIG. 10) is designed for a generally rectangular store space, but includes an angular customer service counter 1018. Storage zone 1012 is separated from customer service zone 1014 by partition 1016 defining passage 1024. Walkway 1020 for sales personnel is located between angular service counter 1018 and partition 1016 and communicates with storage zone 1012 through passage 1024. Customer entrance 1028 provides access to customer fitting area 1022.

Store 1110 (FIG. 11) is designed for an irregular floor plan and includes storage zone 1112 separated by partition 1116 from customer service zone 1114. The service zone includes an angular counter 1118, a walkway 1120 therebehind and communicating directly with passage 1124, and a fitting area 1122 adjacent counter 1118 opposite walkway 1120. Store entrance 1128 provides access to the customer service zone.

Alternative store 1210 (FIG. 12), like stores 10 and 1010 is designed for a rectangular store. Storage zone 1212 is separated from customer service zone 1214 by partition 1216 defining passage 1224. The service zone includes L-shaped customer service counter 1218 and walkway 1220 therebehind and communicating directly through passage 1224 with storage zone 1212. Fitting area 1222 is adjacent service counter 1218 opposite walkway 1220 and is accessed by customers through entrance 1228.

Alternative store 1310 (FIG. 13) includes a primary storage zone 1312*a*, a women's service zone 1314*w*, and a men's service zone 1314*m*. Partitions 1316 and 1316*w* together separate storage zone 1312*a* from women's service zone 1314*w*, and partitions 1316 and 1316*m* together separate storage zone 1312*a* from men's service area 1314*m*. Storage zone 1312*a* includes fixed shelving 1386 and service counters 1346. Secondary storage zone 1312*b* communicates through alcove 1387 with primary storage zone 1312*a* to provide additional storage. In addition to fixed shelving 1386, storage zone 1312*b* also contains a bank 1342 of high density, rolling shelving riding on tracks 1345. Office and utility area 1384 is located adjacent storage zones 1312*a* and 1312*b* opposite customer service zones 1318*m* and 1318*w*. Display windows 1330 are located in store facade 1326, and display cases 1380 are positioned at a plurality of locations along exterior wall 1341. Adjacent store 1382 is adjacent storage zones 1312*a* and 1312*b* and women's service area 1314*w*.

Women's service zone 1314*w* is separated from men's service zone 1314*m* by partition 1388 defining passage 1390 therebetween. Women's zone 1314*w* includes an angular service counter 1318*w*, a walkway 1320*w* adjacent the service counter and communicating through passage 1324*w* with storage zone 1312*a*, and a fitting area 1322*w* adjacent the service counter opposite the walkway. Additionally, customer seating 1368*w* is provided so that customers may be seated along counter 1318*w*. Fitting area 1322*w* is entered through entrance 1328*w*.

Men's service area 1314*m* is similar to women's service area 1314*w* and includes an angular service counter 1318*m*, a walkway 1320*m* adjacent to the counter and communicating through passage 1324*m* with storage zone 1312*a*. A customer fitting area 1322*m* lies adjacent service counter 1318*m* opposite walkway 1320*m* and is entered by customers through entrance 1328*m*. Customer seating 1368*m* is located within fitting area 1322*m* so that customers may be seated at service counter 1318*m*.

Figure 14:
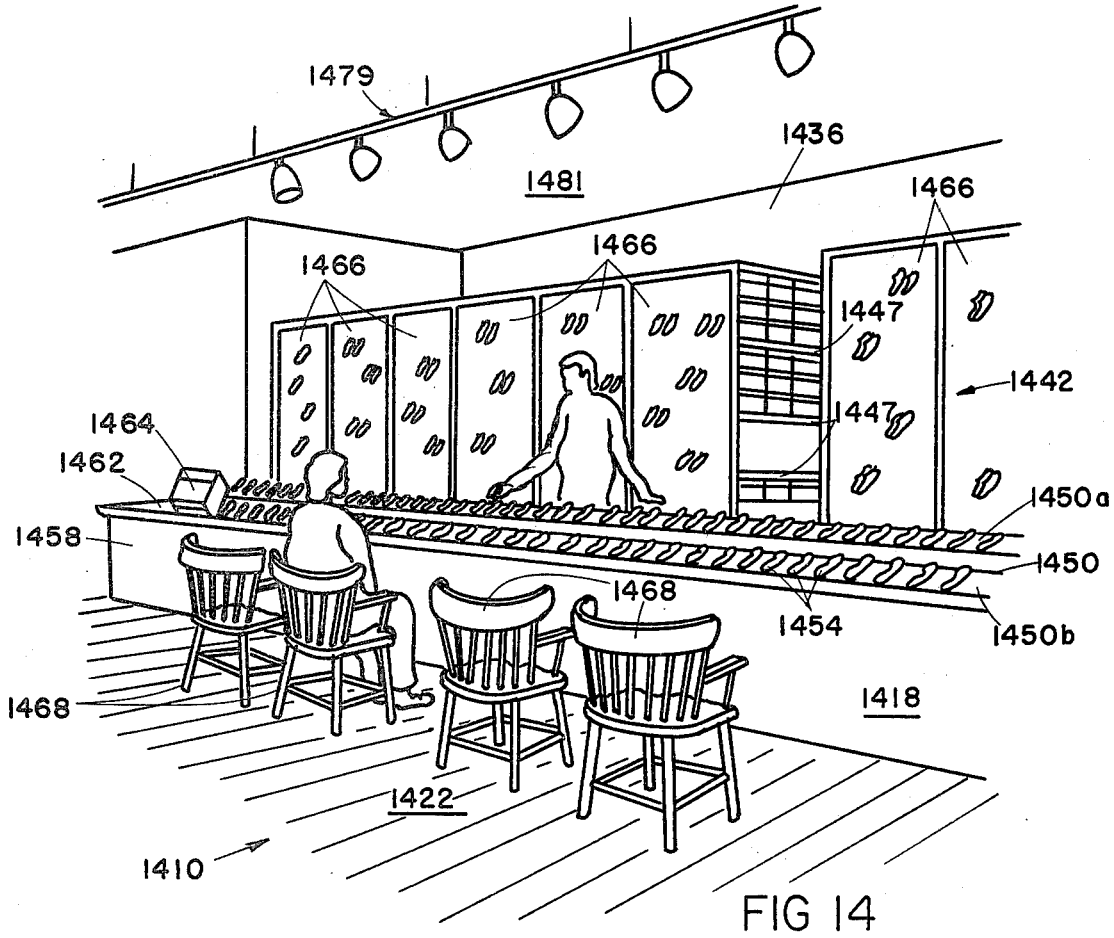
FIG. 14 is a fragmentary, perspective view of a seventh alternative embodiment of the store.
Figure 15:
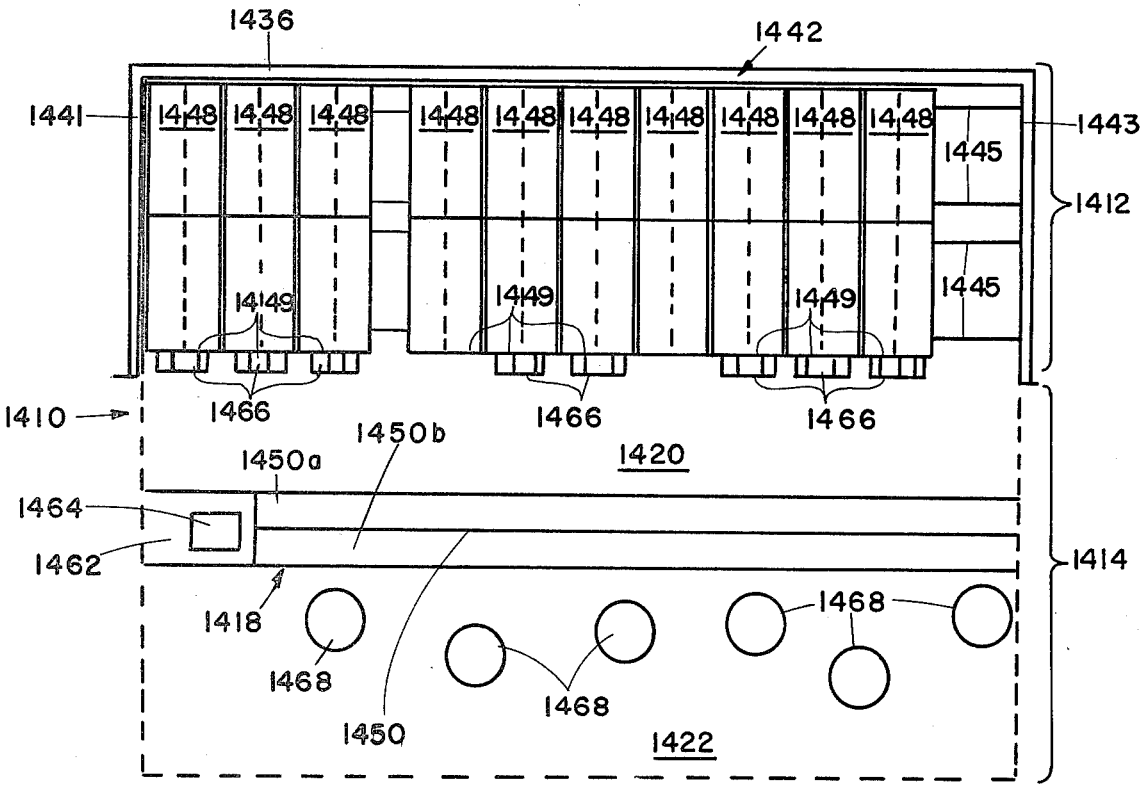
FIG. 15 is a plan view of the seventh alternative embodiment shown in FIG. 14.

Yet another retail assembly 1410 is shown in FIGS. 14 and 15. The primary difference between store 1410 and the previously described stores is that a partition is not included between storage zone 1412 and customer service zone 1414. Assembly 1410 is particularly well adapted for stand-alone placement, for example as a kiosk in the common area of a mall or in a store offering a variety of goods such as a department store. Customer service counter 1418 includes a two-tiered countertop 1450 having upper and lower tiers 1450*a* and 1450*b*, respectively, and cash/wrap area 1462, with cash register 1464, at one end thereof. Fitting area 1422 lies adjacent counter 1418 and includes a plurality of customer seats 1468, enabling customers to be seated at the counter. Also adjacent counter 1418, but opposite fitting area 1422, lies walkway 1420 for sales personnel. Directly behind walkway 1420 are a plurality of rolling shelving units 1448 arranged on tracks 1445 to form bank 1442 of rolling shelving. Preferably, bank 1442 is arranged to provide shelving movement in a direction generally parallel to counter 1418. Each of shelving units 1448 includes a plurality of horizontal shelves 1447 along each side of the unit. Each shelving unit further includes an end 1449 facing counter 1418. Vertical displays 1466 are arranged on selected ones of ends 1449 to provide display area in addition to countertop 1450. Preferably, displays 1466 comprise slatted surfaces into which brackets may be inserted to support shoes 1454'. Track lighting 1479 is mounted on ceiling 1481 and arranged to direct light onto displays 1466 and countertop 1450.

Figure 16:
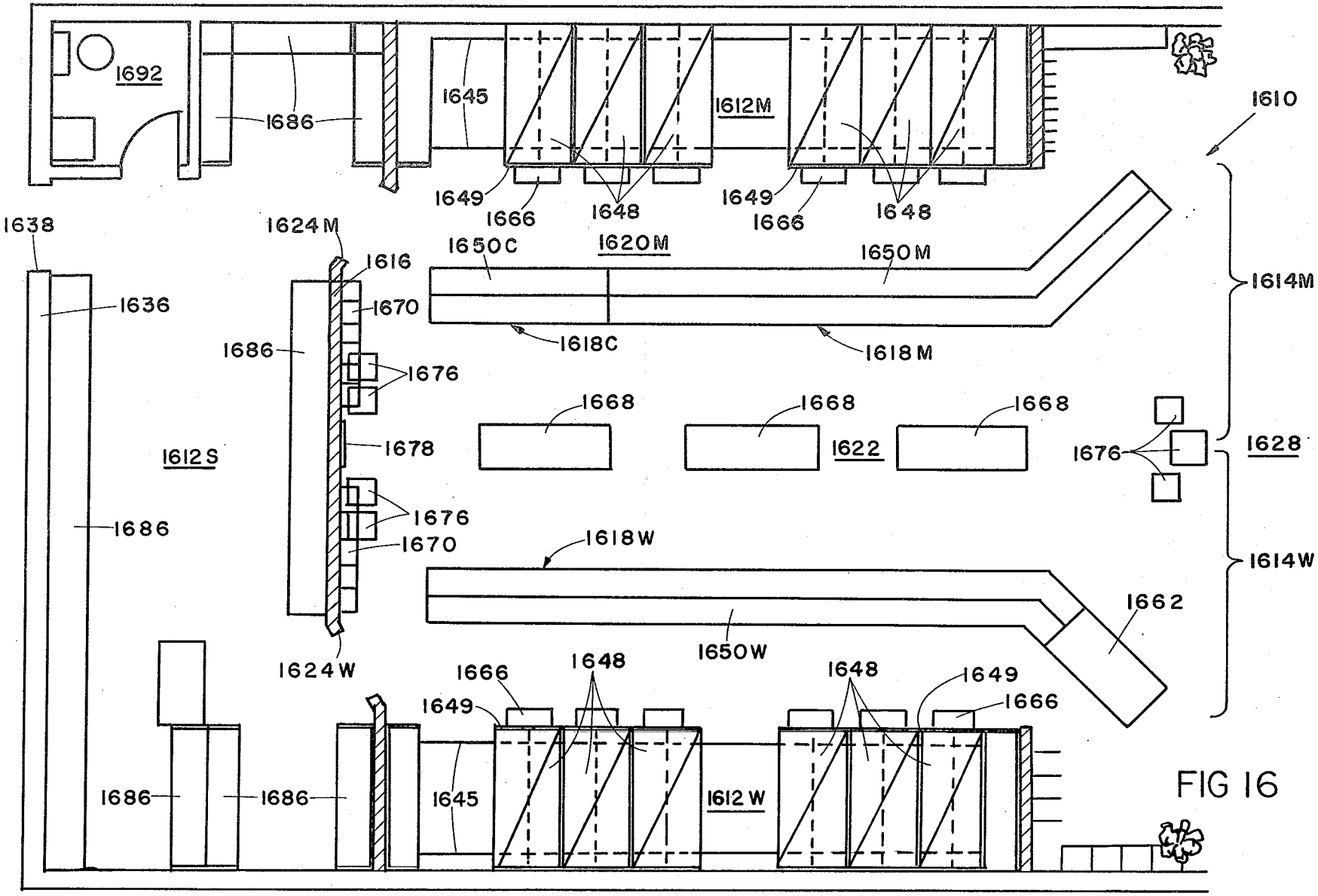
FIG. 16 is a plan view of an eighth alternative embodiment of the store including both men's and women's service zones.

Another store 1610 (FIG. 16) includes men's service zone 1614*m*, men'primary storage 1612*m*, women's service zone 1614*w*, women's primary storage 1612*w* and secondary storage zone 1612*s*. Secondary storage zone 1612*s* includes a rear wall 1636 defining service entrance 1638. Static shelving 1686 is located in secondary storage zone 1612*s* to accommodate stock in addition to stock contained in primary storage zones 1612*m* and 1612*w*. Zone 1612*s* also includes restroom 1692.

Partition 1616 separates secondary storage zone 1612*s* from the remainder of store 1610. Passages 1624*m* and 1624*w* extend through partition 1616 to communicate with men's service zone 1614*m* and women's service zone 1614*w*, respectively. Vertical displays 1670 and mirror 1678 are arranged on partition 1616, and display tables 1676 are provided to increase display area.

Men's service zone 1614*m* includes service counter 1618*m* and walkway 1620*m* located directly therebehind. Children's service counter 1618*c* is provided at one end of men's service counter 1618*m*. Behind walkway 1612*m* and opposite service counter 1618*m* is men's primary storage zone 1612*m*, comprising a plurality of rolling shelving units 1648*m* arranged on tracks 1645. Women's service zone 1614*w* includes service counter 1618*w* and walkway 1620*w* directly therebehind. Service counters 1618*m* and 1618*w* include two-tier countertops 1650*m* 1650*w*, respectively, and are substantially identical to counter 18 previously described. Cash/-wrap area 1662 is located at one end of service counter 1618*w*. Behind walkway 1620*w* and opposite service counter 1618*w* is primary storage 1612*w* comprising a plurality of rolling shelving units 1648 arranged on tracks 1645. Fitting area 1622 is common to both men's and women's service zones 1614*m* and 1614*w* and includes benches 1668 upon which customers may sit while trying shoes. Store entrance 1628 provides customer access to fitting area 1622.

Each of shelving units 1648 includes a plurality of horizontal shelves upon which stock is placed. Further, each unit 1648 includes an end 1649 upon which are mounted vertical displays 1666, which comprise slatted surfaces into which brackets may be inserted to support display shoes.

OPERATION

Prospective customers enter fitting area 22 through store entrance 28 and typically first browse at display shoes arranged on countertop 50, vertical displays 66, 70, and 72, and display tables 76. After deciding on the style shoe which he would like to try, the customer approaches counter 18 and requests a particular size and style shoe from a salesperson on walkway 20. The salesperson then enters storage zone 12 through passage 24 in partition 16 to retrieve the requested shoes and hand same over service counter 18 to the customer. While in storage zone 12, the salesman walks along aisle 40 until he arrives at the one of shelving units 48 containing the requested shoes. The salesman then moves rolling shelving units 48 to have access to the requested shoes which he removes from the shelving unit to return to service zone 14. The customer then tries the requested shoes while seated on one of seats 68.

While the first customer is trying his shoes, the salesperson may service a second customer. If the customer would like to try shoes of a different size and/or style than the first requested shoes, he makes a second request of the salesperson, who retrieves the second pair of requested shoes from the storage zone. The customer and salesman continue to interact, with the customer requesting and trying shoes and the salesman retrieving and handing over shoes, until the customer makes a purchasing decision. If the customer does not desire to make a purchase, all of the shoes are handed over to the salesperson who returns them to storage zone 12. If the customer desires to purchase shoes, both the customer and salesperson proceed to cash/wrap area 62 to complete the purchase. The unpurchased shoes are, of course, returned to the salesperson. After ringing the sale up on cash register 64, the salesperson bags the purchased shoes and hands them over service counter 18 to the customer who then exits store 10 through entrance 28.

When the stock within storage zone 12 is to be replenished, new stock is brought in through service entrance 38 and stored in appropriate positions in shelving units 48. Daily sales logs are completed and other office transactions carried out by a store manager at service desk 46 within storage zone 12.

The operation of alternative stores 810, 910, 1010, 1110, 1210, and 1310 are all similar to the operation of store 10, previously described. Consequently, a detailed explanation of their individual operations is unnecessary. Suffice it to say that customers enter fitting area X22 through store entrance X28 and interact with the salesperson standing on walkway X20 to make shoe purchasing decisions. More particularly, the customer requests shoes from the salesperson, who retrieves the requested shoes from storage zone X12 and hands the shoes over service counter X18 to the customer who tries the shoes. This interactive process continues until the customer decides whether or not to make a purchase.

The operation of assembly 1410 is also somewhat similar to that of store 10. Customers enter fitting area 1422 and peruse display shoes positioned on countertop 1450 and vertical displays 1466. After determining the style of shoe desired, the customer requests the shoes in a particular size from a salesperson located on walkway 1420. This salesperson then determines the one of shelving units 1448 containing the requested shoe, and moves units 1448 as necessary to retrieve the requested shoe from the one unit. The salesman then hands the requested shoes over service counter 18 to the customer who, while seated on one of chairs 1468, tries the shoe. Other customers can be serviced while the first customer is trying shoes. Again, the interactive process continues until the customer decides whether or not to make a purchase. Unpurchased shoes are returned to the salesperson over service counter 18, and the customer and salesperson proceed to cash/wrap area 1462 if necessary to complete a sale.

The operation of store 1610 is similar to that of assembly 1410. Customers enter fitting area 1622 though customer entrance 1628 and peruse display shoes positioned on countertops 1650*m*, 1650*w*, 1650*c*, and vertical displays 1666 and 1670. After determining the style of shoe desired, male customers proceed to service counter 1618*m* to request shoes having a particular size and style from a salesperson located on walkway 1620*m*. The salesperson then determines which of shelving units 1648 adjacent walkway 1620*m* contains the requested shoes, and moves units 1648 as necessary to retrieve the requested shoes from the particular unit. The salesperson then hands the requested shoes over service counter 1618*m* to the customer who tries the shoes. If the customer is female, she proceeds to service counter 1618*w* where a similar interactive process occurs with a salesperson on walkway 1620*w*. Occasionally, the requested footwear is not contained in primary storage zones 1612*m* or 1612*w*, and the salesperson must enter secondary storage zone 1612*s* through one of passages 1624*m* and 1624*w* to retrieve the requested footwear. In the preferred embodiment, boots and other overwear are stored in secondary zone 1612*s* while shoes are stored in primary zones 1612*m* and 1612*w*. The interactive process continues until the customer decides whether or not to make a purchase. Unpurchased shoes are returned to the salesperson who replaces them in shelving units 1648, and the customer and salesperson proceed to cash/wrap area 1662 as necessary to complete a sale.

It should be understood that the above description is intended to be that of preferred embodiments of the invention. Various changes and alterations might be made without departing from the spirit and broader aspects of the invention as set forth in the appended claims, which are to be interpreted with the principles of patent law, including the doctrine of equivalents.

I claim:

1. A retail footwear merchandising assembly comprising:

a customer service zone including customer seating;

a footwear storage zone including a high-density shelving assembly comprising a plurality of rolling shelving units arranged side-by-side, each unit including a pair of opposite sides comprising open shelving, each side facing a side of an adjacent unit, said units being movable in a direction generally perpendicular to said open sides to selectively form walkways between selected pairs of adjacent units enabling sales personnel to access the open shelves of adjacent units from the walkway, each unit further including an end wall facing said customer service zone, selected ones of said unit end walls comprising means for displaying footwear viewable by seated customers in said customer service zone to facilitate request of a particuar size and style of footwear from the sales personnel, to retrieve the requested footwear from said storage zone for said customer.

2. A retail footwear merchandising assembly as defined in claim 1, wherein said means for displaying footwear comprises a slatted surface extending substantially the full width of said unit end wall and capable of receiving shoesupport brackets.

3. A retail footwear merchandising assembly as defined in claim 2, further comprising lighting means for directing light onto said footwear displaying means.

* * * * *